United States Patent [19]

Watts et al.

[11] Patent Number: 5,054,993

[45] Date of Patent: Oct. 8, 1991

[54] ROTARY INTERCEPT STACKING APPARATUS AND METHOD

[75] Inventors: Leonard A. Watts, Hallandale; Medardo Espinosa, Hialeah, both of Fla.

[73] Assignee: IDAB Incorporated, Hialeah, Fla.

[21] Appl. No.: 363,965

[22] Filed: Jun. 9, 1989

Related U.S. Application Data

[63] Continuation-in-part of Ser. No. 876,490, Jun. 20, 1986.

[51] Int. Cl.[5] ..... B65G 57/11; B65H 29/38

[52] U.S. Cl. ..... 414/790.5; 198/431; 414/786; 414/790.4; 414/790.8

[58] Field of Search ..... 271/217; 414/790.8, 414/786, 790.4, 790.5, 790.6; 198/418.6, 431

[56] References Cited

U.S. PATENT DOCUMENTS

| | | | |
|---|---|---|---|
| 3,362,707 | 1/1968 | Lauren | 271/88 |
| 3,379,320 | 4/1968 | Loach et al. . | |
| 3,418,895 | 12/1968 | Palmer | 415/45 |
| 3,548,995 | 12/1970 | Oderman et al. . | |
| 3,831,781 | 8/1974 | Anikanov et al. . | |
| 3,861,537 | 1/1975 | Duchinsky et al. . | |
| 3,908,985 | 9/1975 | Wiseman | 271/189 |
| 4,037,525 | 7/1977 | Sjogren et al. | 93/93 C |
| 4,060,231 | 11/1977 | Stobb et al. | 271/80 |
| 4,139,191 | 2/1979 | Muller | 271/189 |
| 4,470,590 | 9/1984 | Ariga et al. | 271/187 |
| 4,514,128 | 4/1985 | Hedrick | 414/790.8 |
| 4,564,189 | 1/1986 | Noll, Jr. | 271/201 |
| 4,569,622 | 2/1986 | Buck | 414/790.8 |
| 4,678,387 | 7/1987 | Sjogren et al. | 414/790.4 |

FOREIGN PATENT DOCUMENTS

| | | | |
|---|---|---|---|
| 2715705 | 11/1977 | Fed. Rep. of Germany . | |
| 62-16979 | 1/1987 | Japan | 271/217 |
| 566928 | 9/1975 | Switzerland . | |

OTHER PUBLICATIONS

PCT International Search Report for PCT/US90/02935, dated Oct. 5, 1990.

*Primary Examiner*—Robert J. Spar
*Assistant Examiner*—Janice Krizek
*Attorney, Agent, or Firm*—Finnegan, Henderson, Farabow, Garrett & Dunner

[57] ABSTRACT

A signature stacker has an infeed conveyor for conveying signatures in a stream to a reciprocating stacking blade, and a rotary intercept blade driven by a servomotor. The intercept blade intercepts a stream of signatures being delivered to a reciprocating stacking blade to facilitate forming the stream into batches and forming the batches into compensated bundles.

27 Claims, 9 Drawing Sheets

ROTARY INTERCEPT STACKING APPARATUS AND METHOD

RELATED APPLICATIONS

This is a continuation-in-part of U.S. Pat. application Ser. No. 06/876,490 filed Jun. 20, 1986 which is incorporated herein by reference.

BACKGROUND OF THE INVENTION

The present invention relates to signature stackers and, more particularly, to a stacking apparatus with rotary intercept and a method for using it to form batches of signatures.

In the newspaper industry, such stackers are used to receive a stream of overlapped signatures from an infeed conveyor and form the overlapped signatures into discrete batches of stacked signatures. One critical aspect of this process is to intercept the stream of signatures at a precise time in order to form a new batch of signatures which is separated from the previous batch of signatures.

One known signature stacker having a rotary intercept assembly is disclosed in U.S. Pat. No. 4,037,525 to Sjogren et al., which is incorporated herein by reference. A commercial embodiment of that stacker is made by IDAB Incorporated and is known as the IDAB Model 440 stacker. As shown in that patent, the intercept blade assembly of the Model 440 stacker is driven through a clutch assembly by a constant speed A.C. motor. That intercept blade assembly is preloaded by torsion springs and is held preloaded by a retractable stop plate. When the stop plate is retracted, the preloaded intercept blade is abruptly urged into the path of a stream of signatures which is received from an infeed conveyor. The signatures otherwise would have continued to be stacked on a reciprocating stacking blade assembly. When the intercept blade of the IDAB Model 440 stacker is abruptly urged into the intercept position and begins collecting signatures, the infeed conveyor must be raised or elevated to facilitate a proper collection of signatures on the intercept blade.

The intercept assembly for the 440 stacker is complex and requires a large number of moving parts as well as a relatively complicated control mechanism to accomplish the intercept motion of the intercept blade.

Accordingly, it is an object of the present invention to provide a simplified intercept assembly which is more accurate, more predictable, and more reliable.

Additional objects and advantages of the invention will be set forth in the description which follows and in part will be obvious from the description, or may be learned by practice of the invention. The objects and advantages of the invention may be realized and attained by means of the instrumentalities and combinations particularly pointed out in the appended claims.

SUMMARY OF THE INVENTION

To achieve the foregoing objects and in accordance with the present invention, as embodied and broadly described herein, there is provided a method of stacking signatures comprising conveying signatures on an infeed conveyor to an intercept position; rotatably driving a signature support of an intercept assembly from an intercept ready position to the intercept position with a servomotor for selectively intercepting signatures conveyed from the infeed conveyor; transferring signatures from the infeed conveyor to the signature support at the intercept position to collect signatures on the signature support; and subsequently rotating the signature support for discharging the signatures collected on the signature support.

There also is provided a device for stacking signatures comprising infeed conveyor means for conveying signatures to an intercept position; an intercept assembly having a rotatable signature support; servomotor means for driving the intercept assembly and for rotating the signature support from an intercept ready position to the intercept position where signatures transferred from the infeed conveyor means are collected on the signature support for selectively intercepting signatures conveyed from the infeed conveyor means, and for subsequently rotating the signature support for discharging the signatures collected on the signature support.

The accompanying drawings, which are incorporated in and constitute a part of this specification, illustrate an embodiment of the invention and, together with the description, serve to explain the principles of the invention.

DETAILED DESCRIPTION OF THE PREFERRED EMBODIMENT

Reference will now be made in detail to the present preferred embodiment of the invention as illustrated in the accompanying drawings.

Figure 1:
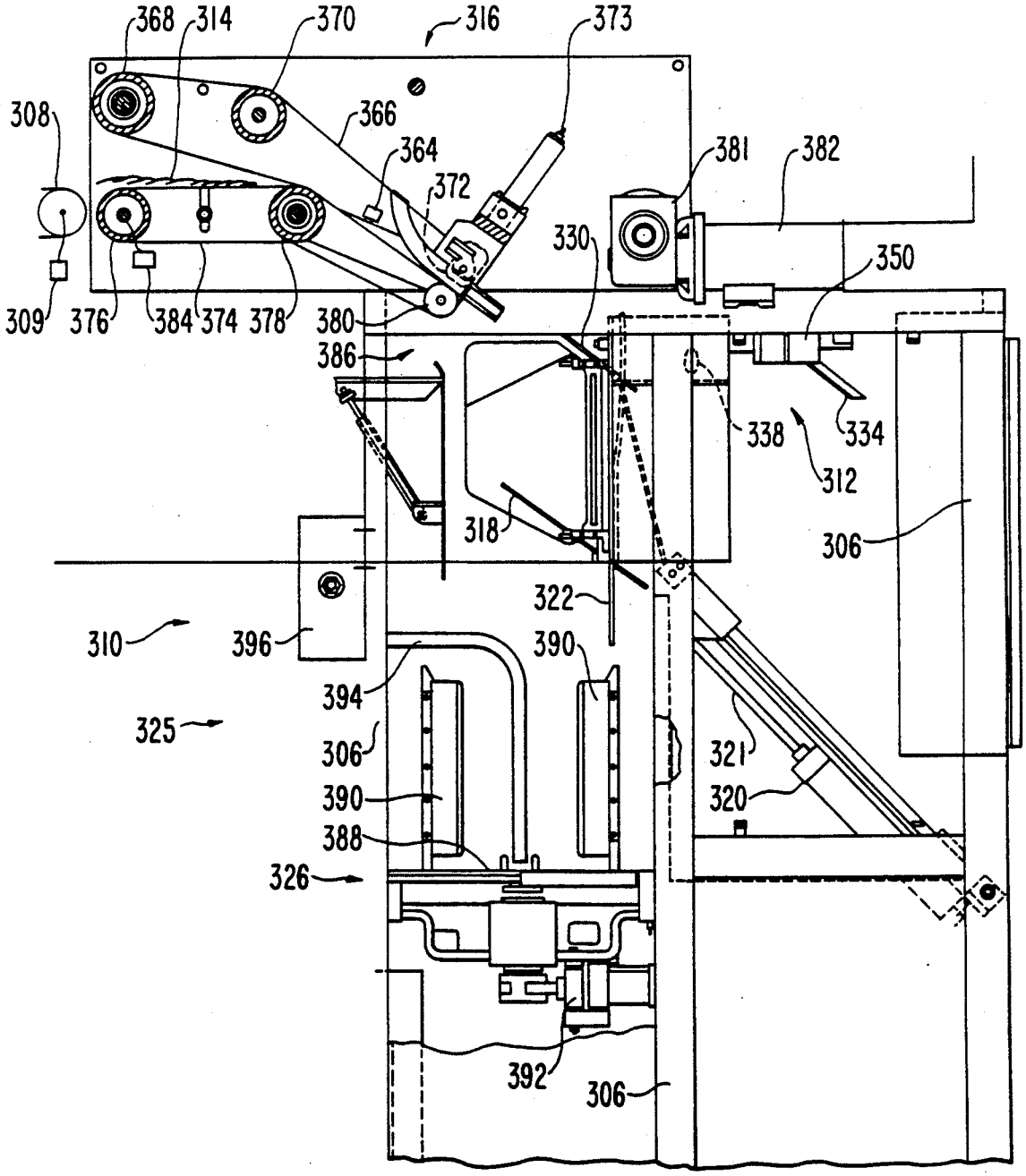
FIG. 1 is a side elevation of a signature stacker incorporating the teachings of the present invention.

As shown in FIG. 1, signature stacker 310 generally comprises an infeed conveyor 316, an intercept assembly 312, a stacking blade 318, a turntable assembly 326 and an ejector assembly 325.

Upstream conveyor 308 delivers a stream of overlapped signatures 314 to the upstream end of infeed conveyor 316. The signatures are oriented with their folded edges forward. Infeed conveyor 316 includes an upper wire belt assembly having upper wire belt 366 entrained about upstream roller 368, intermediate roller 370, and downstream roller 372. Infeed conveyor 316 also includes a lower wire belt assembly having lower wire belt 374, upstream roller 376, intermediate roller 378, and downstream roller 380. Fluid cylinder 373 is operatively mounted to downstream roller 380 and frame 306. Upper and lower wire belt assemblies are driven by infeed D.C. motor 382 which is coupled to gear reducer 381 and mounted on frame 306.

Upstream conveyor 308 operates at a speed which is monitored or detected by upstream tach generator 309 which is coupled to the drive shaft of upstream conveyor 308. Upstream tach generator 309 generates an output voltage having a magnitude proportional to the rotational velocity of upstream conveyor 308, and sends that output voltage to a tach convertor card which adjusts that voltage and sends it to a D.C. motor controller which senses the magnitude of the voltage and uses a comparator circuit to adjust or slave the speed of infeed D.C. motor 382 and, hence, infeed conveyor 316. Upstream tach generator 309 is commercially available from General Electric as model 5PY59EY2B.

The speed of infeed conveyor 316 is monitored by infeed optical encoder 384 which is coupled to the drive shaft of upstream roller 376. Infeed optical encoder 384 generates pulses per unit time representative of revolutions of the drive shaft. Those pulses or encoder counts are sent to the controller which uses those encoder counts along with stored data on the size of upstream roller 376 to compute a linear speed of infeed conveyor 316. Infeed optical encoder 384 is commercially available from EPC as model 220C-12-100-.750.

Figure 2:
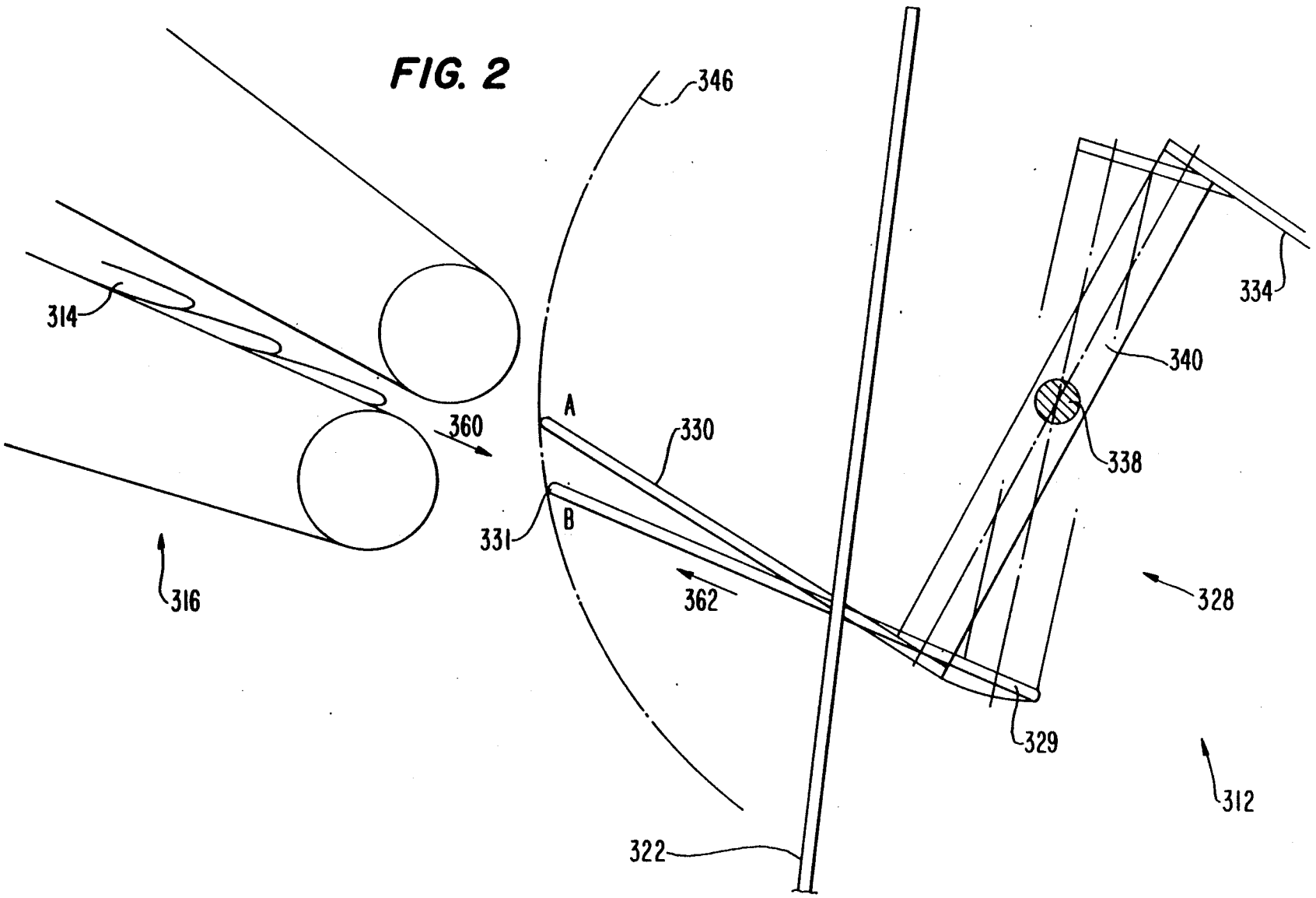
FIG. 2 is a schematic side view of the intercept assembly and the infeed conveyor illustrated in FIG. 1.
Figure 3:
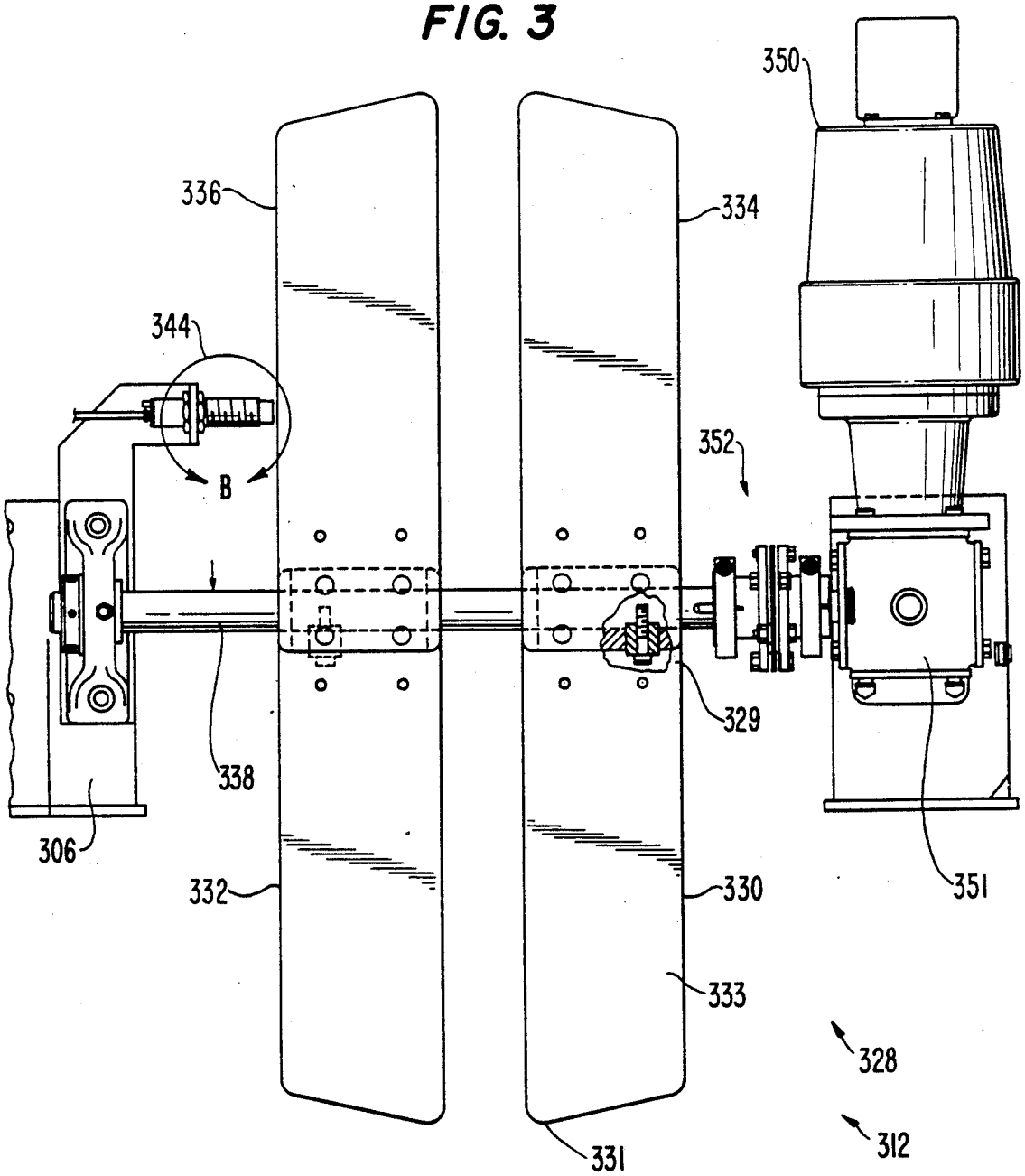
FIG. 3 is a top plan view of the intercept assembly illustrated in FIG. 1.
Figure 4:
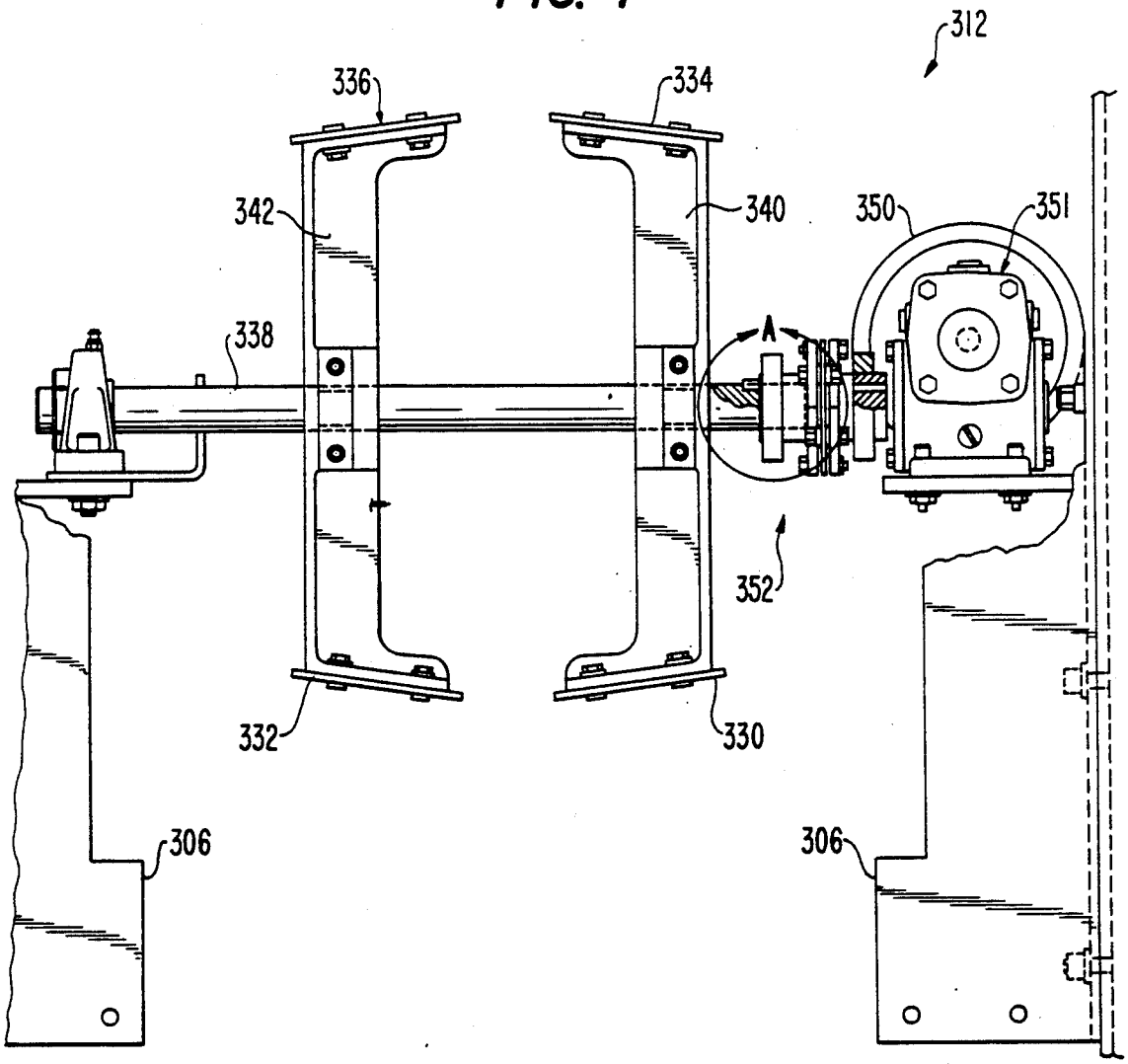
FIG. 4 is an end view of the intercept assembly illustrated in FIGS. 1–3.

According to the present invention, the signature stacker includes an intercept assembly having a rotatable signature support. As illustrated in FIGS. 2–4, the preferred embodiment includes an intercept assembly 312 with a rotatable signature support 328. Signature support 328 includes a first pair of intercept blades 330 and 332 respectively mounted on support arms 340, 342 and a second pair of intercept blades 334, 336 also mounted on support arms 340, 342, respectively. Support arms 340, 342 are mounted on rotatable shaft 338 and each arm extends radially in diametrically opposed directions. It is also possible to have only one pair or set of intercept blades. The left-hand end of shaft 338 as shown in FIGS. 3 and 4 is rotatably mounted to frame 306.

Sensor 344 is mounted on frame 306 at a selected "home" position, and outputs a signal when it senses that support arm 342 passes the home position.

The rotatable signature support preferably includes a base, a tip, and a support surface extending from the base to the tip in a longitudinal direction for supporting the intercepted signatures. Preferably, rotatable signature support 328 includes base 329 and intercept blade 330 which extends from base 329. Intercept blade 330 includes tip 331 and supports surface 333 extending from base 329 to tip 331 in longitudinal direction 362. The other intercept blades are similarly configured.

Also in accordance with the invention, the signature stacker includes servomotor means for driving the intercept assembly and for rotating the signature support from the intercept ready position to the intercept position. It is preferable that the servomotor means is directly coupled to the signature support means.

As illustrated in FIGS. 1–3, the servomotor means includes servomotor 350. Servomotor 350 is operatively coupled to gear reducer 351 which in turn is operatively coupled to shaft 338 through coupling assembly 352. Intercept blades 330 and 332 are mounted on shaft 338 through support arms 340 and 342. Servomotor 350 is thus directly coupled to the signature support of intercept blades 330 and 332, and the signature support of intercept blades 334 and 336.

Servomotor 350 and gear reducer 351 are mounted on frame 306. It is preferable that servomotor 350 is a so-called disk armature or low inertia armature servomotor such as Model No. JR12M4CH servodisc armature motor commercially available from PMI Motion Technologies. Power is supplied to servomotor 350 by a pulse width modulated D.C. servoamplifier, controlled by an electronic circuit, including a large-scale integrated circuit component manufactured by Hewlett Packard, commercially available as HCTL1000 Motion Controller, which itself is a microprocessor-controlled device.

Stacking blade 318 is mounted to frame 306 and is driven, relative to backrib member 322, in a reciprocating fashion by fluid cylinder 320 and its piston member 321, as described in greater detail in U.S. Pat. No. 4,037,525.

Turntable assembly 326 includes turntable 388 and upright sidewalls or guides 390 for holding and neatly stacking signatures 314 delivered onto turntable 388. Turntable drive means 392 is mounted to frame 306 and rotates turntable 388 in order to form compensated bundles of signatures 314. Ejector assembly 325 includes an ejector or pusher arm 394, pusher sensors, and ejector driving means 396 mounted to frame 306. Turntable assembly 326 and ejector assembly 325 are further described in U.S. Pat. No. 4,037,525.

In operation, signatures 314 are conveyed in a stream from upstream conveyor 308 to infeed conveyor 316 which delivers the stream of signatures to retractable stacking blade 318 in order to form a batch of signatures of a preselected quantity on stacking blade 318.

Counter 364 counts signatures 314 as they are conveyed on infeed conveyor 316. The count is sent to the controller, in conjunction with data received from encoder 384, which is able to calculate the rate at which signatures 314 are being conveyed, and the linear separation distance between the leading folded edges of successive individual signatures on infeed conveyor 316. Preferably, the rate detecting means includes counter 364, encoder 384, and the controller. The thickness of signatures 314 may vary (for example, Sunday newspapers are typically thicker than Monday newspapers). Accordingly, data on the thickness of signatures being conveyed may be input into the controller.

When the selected number of signatures have been delivered to retractable stacking blade 318, intercept assembly 312 momentarily intercepts the stream of signatures 314 by rapidly rotating intercept blades 330 and 332 from intercept ready position A into intercept position B, shown in FIG. 2. At times when intercept blade 330, for example, is in intercept ready position A, signatures 314 are conveyed by infeed conveyor 316 along direction 360 so that signatures 314 pass beneath intercept blade 330 as shown in FIG. 2. Signatures 314 strike backrib member 322 and drop onto stacking blade 318. At times when intercept blade 330, for example, after rotating through the stream of signatures 314, is in intercept position B, intercept blade 330 intercepts and collects signatures 314 that otherwise would have been collected on stacking blade 318, thus preventing them from falling onto stacking blade 318 in order to allow stacking blade 318 to unload its batch of signatures.

Because intercept blade 330 rotates about shaft 338, tip 331 travels in a circular path. Arc 346 of that circular path is illustrated in FIG. 2. Thus, as distinct from known intercept assemblies which require the use of a cam to accomplish an abrupt intercept motion, the intercept blade of this invention exhibits a smoother path of travel and requires fewer parts. Moreover, as distinct from known intercept assemblies which require the use of a latch or stop plate, the intercept blade of the present invention exhibits an uninterrupted and unobstructed path of travel by solely relying on the servomotor to control its position and movement characteristics.

While intercept blades 330 and 332 are intercepting and collecting signatures 314, retractable stacking blade 318 is retracted in a linear fashion, diagonally downwardly and to the right as shown in FIG. 1 by fluid cylinder 320. Because of backrib member 322, retractable stacking blade 318 slides out from underneath the batch of signatures which it had been supporting. That batch then falls downwardly onto turntable assembly 326. Retractable stacking blade 318 then returns to its extended position illustrated in FIG. 1 in readiness to collect another stack of signatures 314, and intercept blades 330 and 332 rotate out of intercept position B, shown in FIG. 2. In so rotating, signatures collected by intercept blades 330 and 332 are allowed to fall onto stacking blade 318. At the same time, infeed conveyor 316 continues to deliver additional signatures 314 to retractable stacking blade 318.

Although in one preferred embodiment the rotational speed or angular velocity of the signature support means is not related to the detected rate of signatures 314 on infeed conveyor 316, it is possible to control the signature support means so that it rotates, for example, from the intercept ready position to the intercept position at a speed which is a function of that detected rate. That functional relationship can be direct. In other words, any increase or decrease in the detected rate could yield a directly proportional increase or decrease in rotational speed of the signature support means.

In accordance with the present invention, the signature stacker includes infeed conveyor means for conveying signatures to an intercept position. As embodied herein, the infeed conveyor means includes infeed conveyor 316 and a counter 364 which counts signatures and sends a signal to the controller upon every count. The controller provides a trigger signal after a predetermined count. That trigger signal serves to activate, after a predetermined delay period, intercept assembly 312. In one preferred embodiment, the counting means includes a mechanical counter disclosed in U.S. Pat. No. 3,702,925, commercially available from IDAB Incorporated.

As distinct from known stackers such as the IDAB Model 440 stacker, infeed conveyor 316 of the present invention continues to operate, after activation of intercept assembly 312, without raising or elevating infeed conveyor 316 with respect to frame 306, intercept blade 330 of signature support 328, or intercept position B. In other words, downstream end 386 of infeed conveyor 316 is fixed in the plane of FIG. 1 during operation (except for its dump gate capability and its resiliency capability) so that signatures are substantially continuously or constantly provided along direction 360.

The dump gate capability refers to the ability of downstream roller 380 and lower wire belt 374 to rotate or swing downwardly and to the left in FIG. 1 about the shaft of roller 378 in order to dump signatures away from stacking blade 318 or turntable 388. This dump gate capability is exercised when a jam is detected and is further described in parent application U.S. Pat. application Ser. No. 06/876,490. The resiliency capability refers to the ability of downstream end 386 to accommodate the varying thickness of each individual signature (which typically increases from the very leading edge to a maximum thickness and then gradually decreases toward the trailing edges). Every time a leading edge encounters downstream roller 380, lower downstream roller 380 moves apart from downstream roller 372 sufficiently to permit passage of the signature. Fluid cylinder 373 resiliently urges lower downstream roller 380 upward toward roller 372 for compressing signatures 314 against roller 372. It may be appreciated that the extent of movement of downstream roller 380 is relatively insubstantial and does not alter the direction 360 in which signatures are conveyed.

In this context, accordingly, the term "fixed" refers to preclusion of translational movement of infeed rollers 372 and 380 either up and down or left and right in the plane of FIG. 1 which is of sufficient magnitude to alter significantly direction 360; the term does not, of course, refer to preclusion of rotational movement of those rollers about their respective shafts. An important consequence of this fixed relationship between downstream end 386 of infeed conveyor 316 and intercept blade 330 is that longitudinal direction 362 of support surface 333 is substantially parallel to direction 360 at times when the signature support 328 is in intercept position B. Also in this context, the term "substantially parallel" means an angular relationship not exceeding about plus or minus 5° . In other respects, infeed conveyor 316 is described in greater detail in U.S. Pat. No. 4,037,525 to Sjogren et al.

FIGS. 5–8 depict a flow chart for the operation of the stacker. Numbers inside the boxes on FIGS. 5–8 indicate a source or a destination of a command and boxes marked with an asterisk indicate that other tasks are allowed to run while the asterisked task waits.

Figure 9:
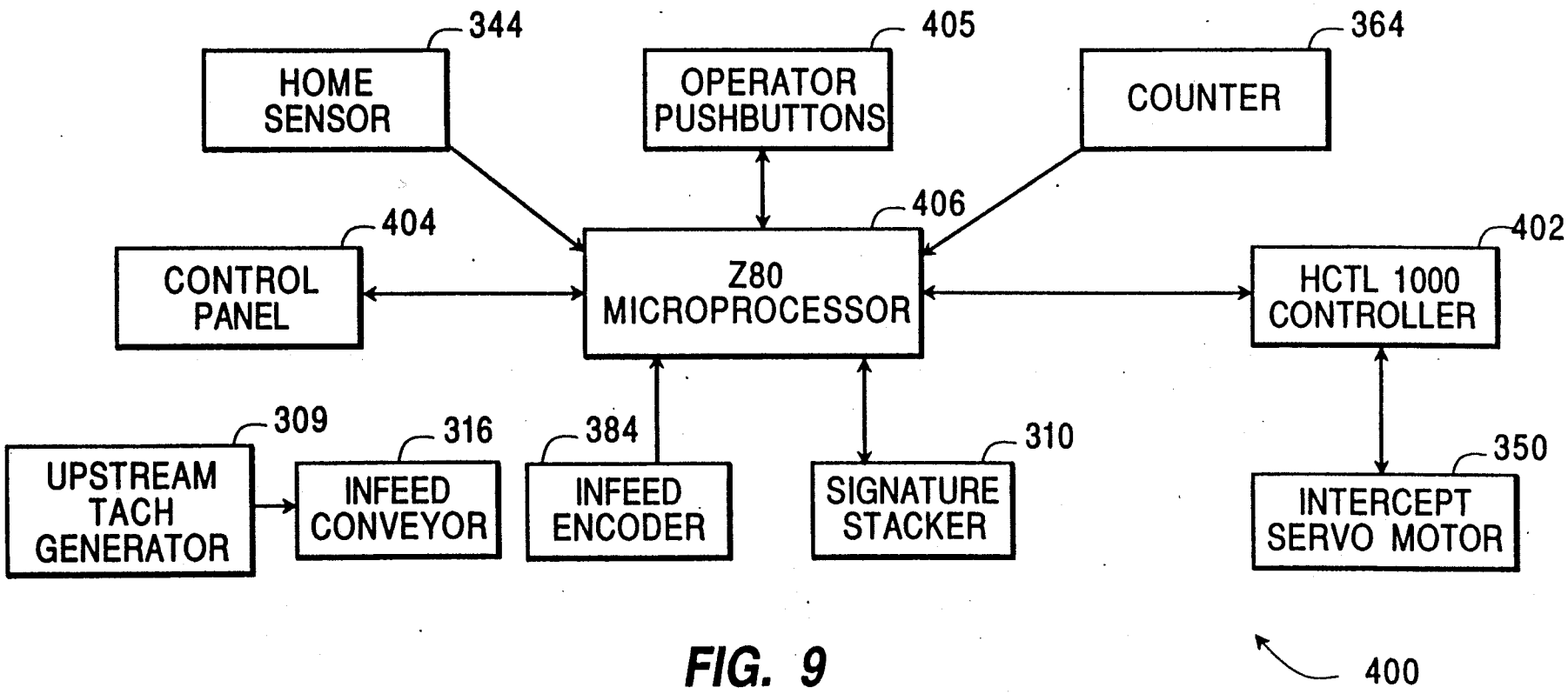
FIG. 9 is a schematic diagram showing a control circuit of the present invention.

As illustrated in FIG. 9, control system 400 includes controller 402, control panel or console 404, operator pushbuttons 405, and microprocessor 406 for controlling the operation of signature stacker 310.

In operation, a microprocessor controls all machine functions. Bundle information is preprogrammed into a memory of the microprocessor so that the stacker will produce bundles with a selected number of signatures and selected orientation. Programmed information includes, for example, with regard to a compensated bundle, the number of signatures per turn, and the direction in which the completed stack is to be ejected out of the stacker.

Figure 5:
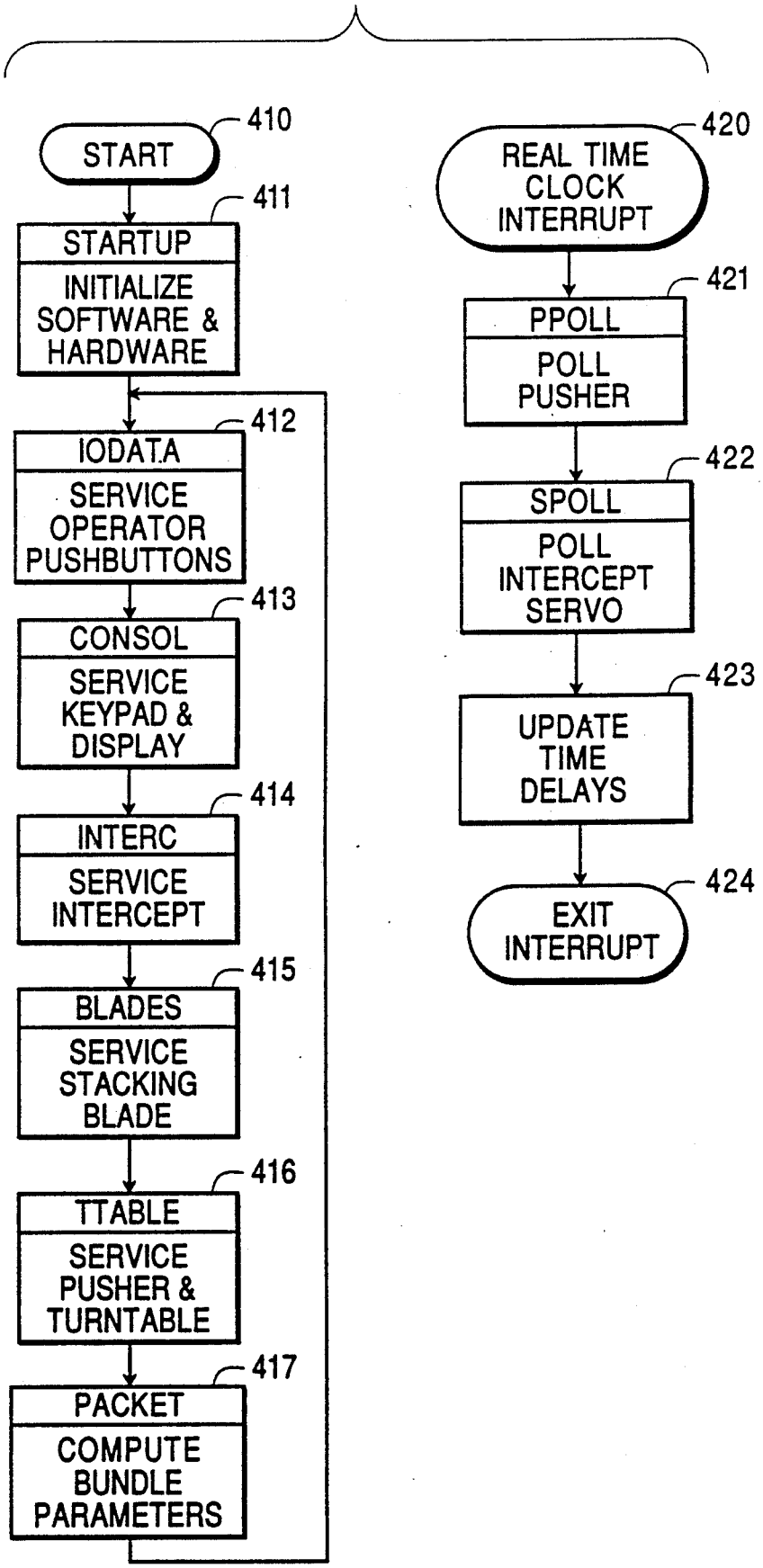
FIGS. 5–8 are flow charts depicting the control and operation of a signature stacker incorporating the teachings of the invention.

The flow charts of FIGS. 5–8 diagrammatically disclose the operation of the control system for the preferred embodiment. The control system includes a Z80 microprocessor chip which functions as a central processing unit (CPU), a memory, and input/output devices. The Z80 is commercially available from Zilog. As shown in FIG. 5, when the stacker is energized, the microprocessor enters into the initial step 410 of the program which initializes the software and hardware at 411 by presetting parameters such as destination and source for memory and commands. The control system then reacts to operator pushbuttons at input/output data block 412. The program then reacts to keyboard entries from the console at 413 service keypad and display. At 414, the microprocessor services the intercept; i.e., it receives information regarding where the intercept blade is, compares that information with where it should be, and, if necessary, takes corrective action. At 415, the microprocessor services the stacking blade; at 416 it services the turntable and the pusher or ejector; and at packet 417 it computes bundle parameters. The microprocessor then loops back to 412 and continuously services input/output data, the console, the intercept, stacking blade, the turntable assembly, ejector assembly, and the bundle parameters in a repetitive fashion.

The microprocessor further includes a real time clock which initiates an interrupt of the normal routine every selected period of milliseconds. Upon initiation of an interrupt at 420, the microprocessor polls or reads the state of the pusher-bar sensors in the ejector assembly at 421. Then the microprocessor polls or reads the HCTL1000 motion control chip for the location of the intercept blade at 422 for the purpose of programming a succession of decreasing velocities to slow the intercept blade to a stop at the intercept ready position when the intercept blade is located from the home position to the intercept ready position. The microprocessor also updates time delays at 423, either incrementing or decrementing timers used to monitor functions throughout the stacker. The next step to be performed in the normal routine was previously stored at the initiation of the interrupt at 420. Thus, when the interrupt routine is terminated at 424, the microprocessor exits from the interrupt routine and returns to the next program step to be performed in the normal routine by returning to the program step whose location was stored in memory at 420 of the real time clock interrupt routine.

Figure 6:
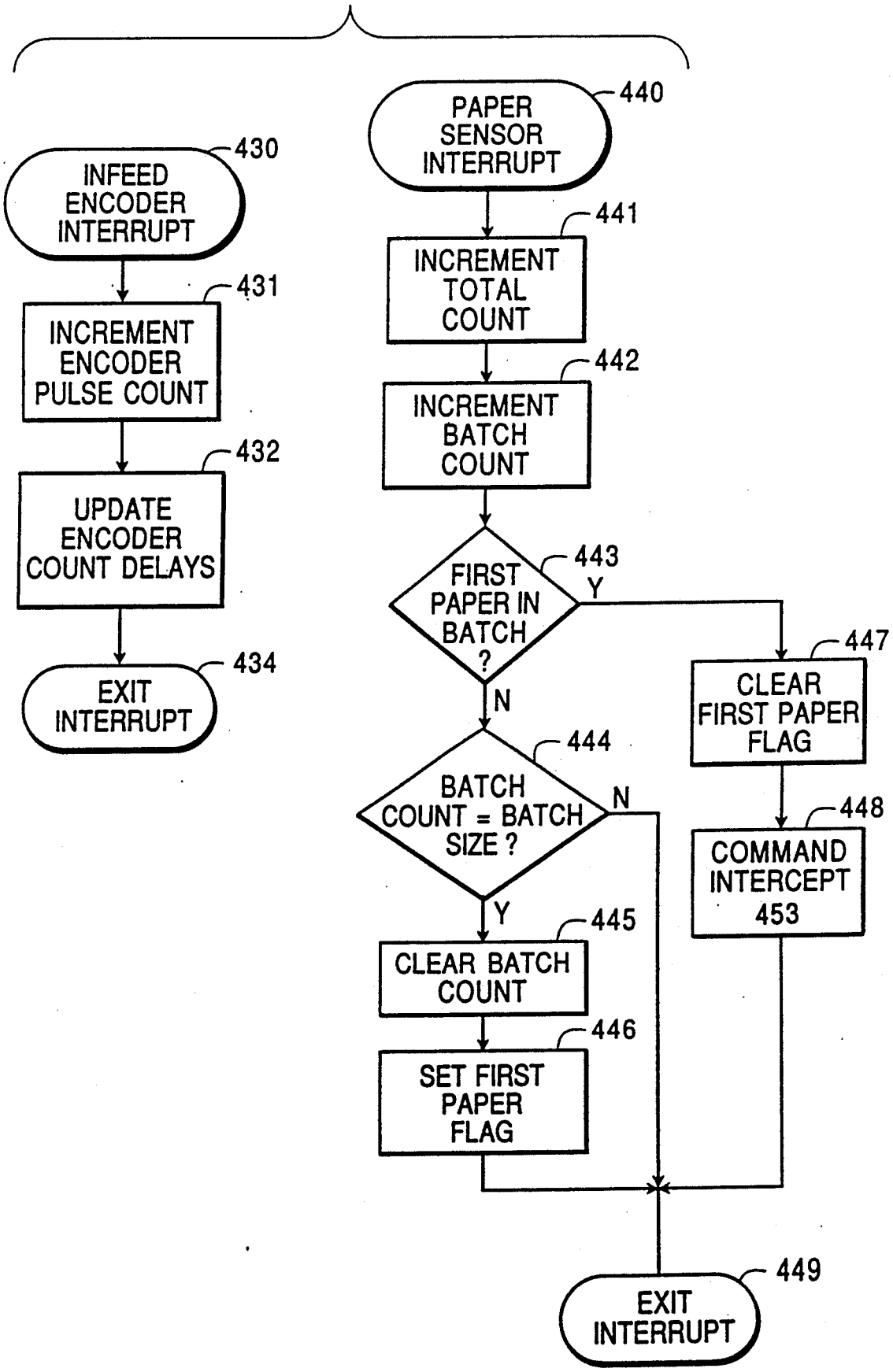

As illustrated in FIG. 6, the normal routine is interrupted by the infeed encoder interrupt at 430. At 431 the microprocessor increments the encoder pulse count, retrieving a value set in the memory during a previously selected time period, adding one to that value and returning the added value back to the memory; this data is used to compute the speed of the infeed conveyor 316. At 432, encoder count delays are updated with every encoder pulse, which, if not 0, is decremented by one. The microprocessor then exits the infeed encoder interrupt at 434.

Paper sensor interrupt is initiated at 440. The microprocessor increments a total count at 441, and increments a batch count at 442. At 443 the microprocessor determines whether a given paper is to be the first paper in a batch. If it is not, the microprocessor next decides at 444 whether the batch count has attained a completed batch size. If it has, then the microprocessor clears the batch count at 445 and sets the first paper flag at 446 and then exits the interrupt at 449. If, at 444, the batch count does not equal the batch size, the microprocessor proceeds directly to exit the interrupt routine at 449. And if, at 443, the microprocessor determines that a given paper is indeed the first paper in a batch, then the microprocessor clears the first paper flag at 447 and commands the intercept at 448 (a command destined for block 453 to be discussed below) and the microprocessor then exits the interrupt routine at 449. It is thus evident that the intercept command is triggered, in this embodiment, not by the last paper of a given batch, but rather by the first paper in a succeeding batch.

Figure 7:
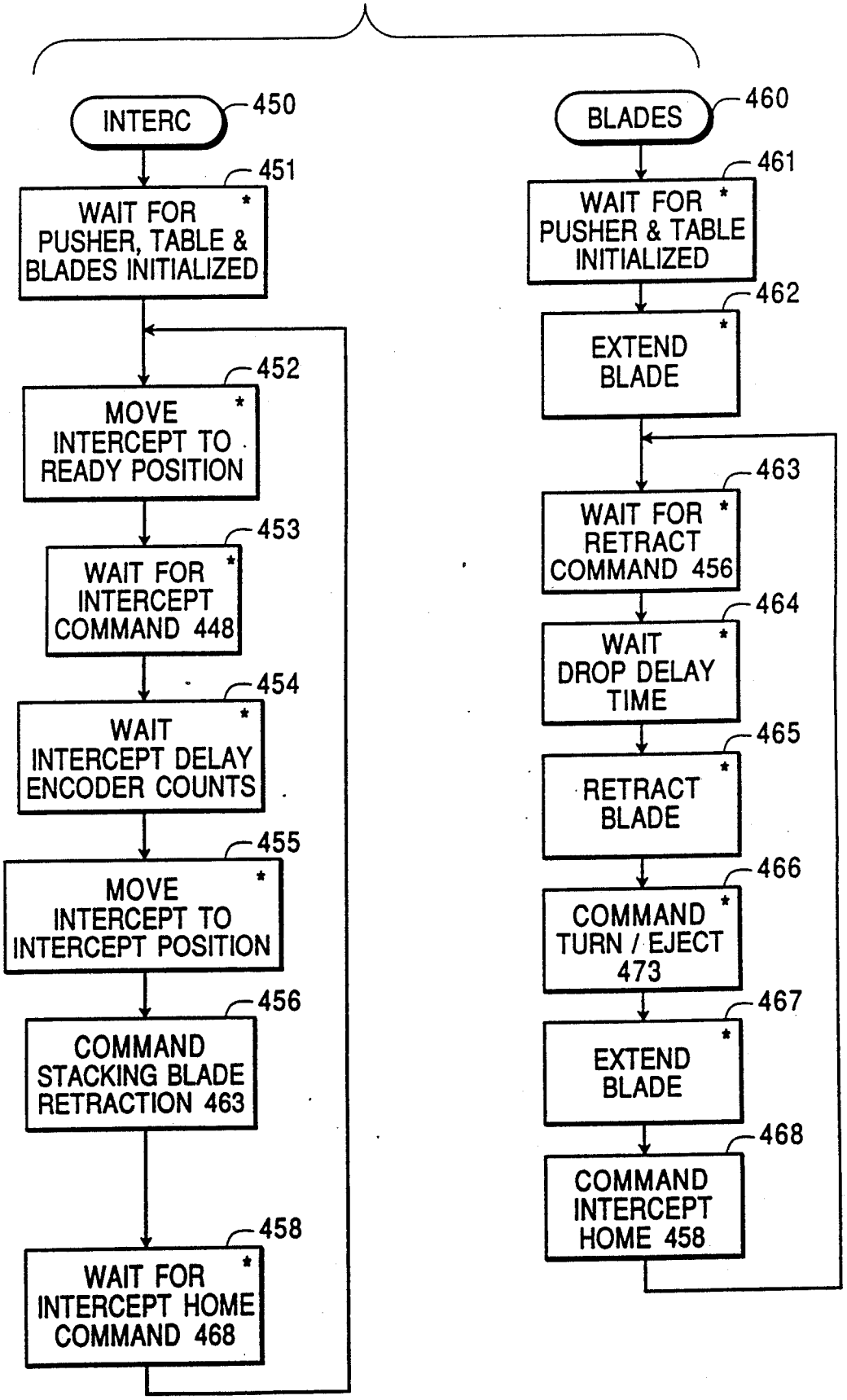

The intercept routine is initiated at 450 as illustrated in FIG. 7. The microprocessor waits for the turntable and ejector assemblies and the stacking blade to be readied or initialized at block 451. At 452 the intercept blade moves to the intercept ready position. At 453 the microprocessor waits for the intercept command to be received from block 448. And at 454, microprocessor delays for a given number of encoder counts in order to allow the last paper of a given batch to pass beneath the intercept blade. After waiting the appropriate time, the microprocessor commands the movement of the intercept blade into the intercept position at 455. Depending on the delivery rate of the infeed conveyor 316, the number of signatures collected on the intercept blade varies; in one test, three or four signatures were collected on the intercept blade. While these signatures are being collected on the intercept blade, the microprocessor commands at 456 a retraction of the stacking blade, a command destined for block 463 as illustrated in FIG. 7. At 458, the microprocessor waits to receive an intercept home command from 468. The microprocessor then loops back to 452 moving the intercept blade into the ready position and consequently dumping all the signatures previously collected on the intercept blade.

The stacking blade routine is initiated at block 460. At 461 the microprocessor waits for the turntable and ejector assemblies to be initialized and at 462 extends the stacking blade into its extended position prepared to receive signatures. At 463 the microprocessor waits to receive the retraction command from block 456. The microprocessor then waits at 464 for a given drop delay time to allow the last paper of a given batch to fall onto the stacking blade (a time measured in numbers of encoder counts). At 465 the microprocessor retracts the stacking blade and at 466 the microprocessor commands either the turntable or ejector assembly, a command destined for 473. At 467 the stacking blade is again extended into position prepared to receive signatures and at 468 the microprocessor commands the intercept blade to return home, a command destined for 458. The stacking blade routine then returns to block 463 to wait for the next retraction command.

Figure 8:
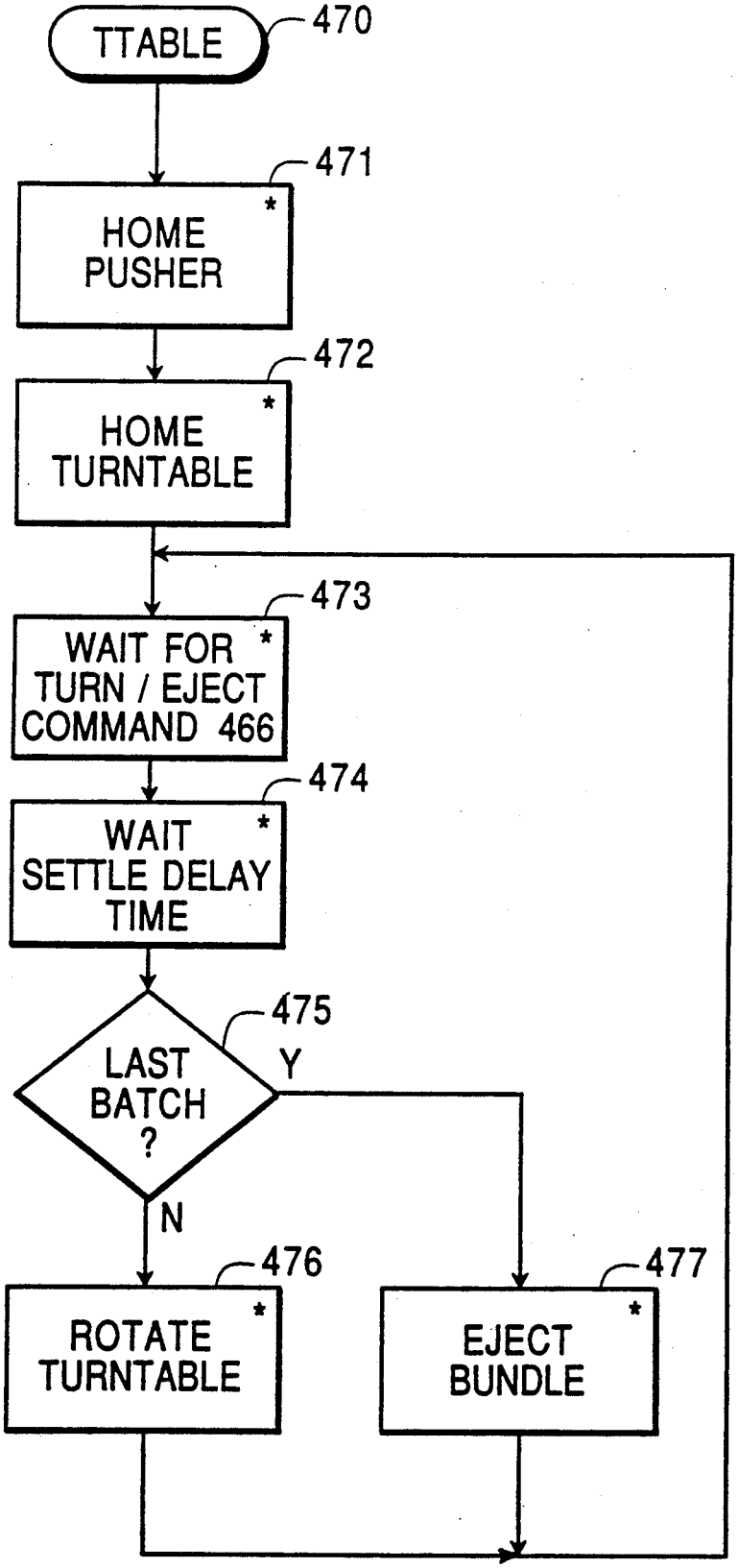

The turntable routine is initiated at block 470 as illustrated in FIG. 8. At block 471 the ejector or pusher is initialized by moving to the home position, and at 472 the turntable is initialized by moving to its home position. At 473 the microprocessor waits for either a turntable or ejector command to be received from 466 and then waits at 474 for a determined amount of time to allow a batch of papers to settle on the turntable. At 475 the microprocessor decides whether a given batch is a last batch of a bundle and, if not, the microprocessor rotates the turntable at 476 to create a compensated bundle. If a given batch is determined to be the last batch of a bundle at 475, then that bundle is ejected at 477 and the turntable routine returns to block 473.

Additional advantages, modifications, and variations will be apparent to those skilled in the art. The invention in its broader aspects is, therefore, not limited to the specific detail, representative apparatus, and illustrative example shown and described. Accordingly, departures may be made from such details without departing from the scope or spirit of the present invention.

We claim:

1. A method of stacking signatures comprising:

conveying signatures on an infeed conveyor to an intercept position;

monitoring the location of a rotatable signature support of an intercept assembly by repetitively receiving information regarding the actual location of the signature support and comparing that information with information regarding the correct location of the signature support;

rotatably driving the signature support from an intercept ready position to the intercept position with a servomotor for selectively intercepting signatures conveyed from the infeed conveyor;

controlling the servomotor responsive to the monitored location of the signature support by taking corrective action when necessary to move the signature support from its actual location to the correct location;

transferring signatures from the infeed conveyor to the signature support at the intercept position to collect signatures on the signature support; and subsequently rotating the signature support for discharging the signatures collected on the signature support.

2. The method of claim 1 including receiving the collected signatures from the intercept assembly signature support on a stacking blade and forming a batch of signatures on the stacking blade.

3. The method of claim 1 wherein the rotatably driving step includes driving the signature support at all times at a speed which is substantially proportional to the speed of the servomotor.

4. The method of claim 1 including:

maintaining the signatures support substantially parallel to the direction in which the signatures are conveyed from the infeed conveyor when the signature support is in the intercept position.

5. The method of claim 1 including:

maintaining the infeed conveyor in a fixed relationship with the signature support when the signature support is in the intercept position.

6. The method of claim 4 including:

maintaining the infeed conveyor in a fixed relationship with the signature support when the signature support is in the intercept position.

7. A device for stacking signatures comprising:

infeed conveyor means for conveying signatures to an intercept position;

an intercept assembly having a rotatable signature support;

servomotor means for rotatably driving the signature support of the intercept assembly from an intercept ready position to the intercept position where signatures transferred from the infeed conveyor means are collected on the signature support for selectively intercepting signatures conveyed from the infeed conveyor means, and for subsequently rotating the signature support for discharging the signatures collected on the signature support; and control means for monitoring the location of the signature support and for controlling the servomotor means in response to the monitored location of the signature support by repetitively receiving information regarding the actual location of the signature support, comparing that information with information regarding the correct location of the signature support and taking corrective action when necessary to move the signature support from its actual location to its correct location.

8. The device of claim 7 including a stacking blade for receiving the collected signatures from the intercept assembly signature support and for forming a batch of signatures.

9. The device of claim 7 wherein:

the infeed conveyor means is fixed in place and includes a downstream end for conveying a stream of signatures in a first direction;

the rotatable signature support includes a base, a tip, and a support surface extending from the base to the tip in a longitudinal direction for supporting the intercepted signatures; and wherein the longitudinal direction of the support surface is substantially parallel to the first direction when the signature support is in the intercept position.

10. A method of stacking signatures comprising:

conveying signatures on an infeed conveyor to an intercept position;

detecting the rate at which the signatures are conveyed on the infeed conveyor;

rotating a signature support of an intercept assembly from an intercept ready position to the intercept position at a speed which is a function of the detected rate at which the signatures are conveyed on the infeed conveyor; and transferring signatures from the infeed conveyor to the signature support at the intercept position to collect signatures on the signature support.

11. The method of claim 10 wherein:

the rotating step includes driving the signature support of the intercept assembly with an intercept assembly servomotor operated at a speed which is a function of the detected rate at which the signatures are conveyed on the infeed conveyor.

12. The method of claim 11 wherein:

the rotating step includes driving the signature support at all times at a speed which is substantially proportional to the speed of the intercept assembly servomotor.

13. The method of claim 10 including:

generating a signature count by counting each signature as it is conveyed on the infeed conveyor;

detecting the speed of the infeed conveyor; and rotating the signature support at a speed which is a function of the signature count and the detected speed of the infeed conveyor.

14. The method of claim 10 including:

conveying signatures on an upstream conveyor upstream of the infeed conveyor;

transferring the signatures from the upstream conveyor to the infeed conveyor;

detecting the speed of the upstream conveyor; and controlling the speed of the infeed conveyor in response to the detected speed of the upstream conveyor.

15. The method of claim 10 including controlling the speed of the signature support as a function of signature thickness.

16. The method of claim 10 including controlling the speed of the signature support as a function of signature separation on the infeed conveyor.

17. The method of claim 10 including controlling the speed of the signature support as a function of signature thickness and signature separation on the infeed conveyor.

18. A device for stacking signatures comprising:

infeed conveyor means for conveying signatures to an intercept position;

rate detecting means for detecting the rate at which the signatures are conveyed on the infeed conveyor means; and intercept assembly means, having signature support means for receiving signatures from the infeed conveyor means at the intercept position and rotating means for rotating the signature support means from an intercept ready position to the intercept position at a speed which is a function of the detected rate at which the signatures are conveyed on the infeed conveyor means, for collecting signatures on the signature support means.

19. The device of claim 18 wherein:

the rotating means includes intercept assembly servomotor means, operated at a speed which is a function of the detected rate at which the signatures are conveyed by the infeed conveyor means, for driving the signature support means.

20. The device of claim 19 wherein:

the intercept assembly servomotor means is directly coupled to the signature support means for driving the signature support means at all times at a speed which is substantially proportional to the speed of the intercept assembly servomotor means.

21. The device of claim 18 including:

means for detecting the speed of the infeed conveyor means; and means for generating a signature count by counting each signature as it is conveyed on the infeed conveyor means and for controlling the rotating means to operate at a speed which is a function of the signature count and the detected speed of the infeed conveyor means.

22. The device of claim 18 including:

upstream conveyor means upstream of the infeed conveyor means for conveying signatures to the infeed conveyor means;

means for detecting the speed of the upstream conveyor means; and means for controlling the speed of the infeed conveyor means in response to the detected speed of the upstream conveyor means.

23. The device of claim 18 wherein:

the rotating means includes means for controlling the speed of the signature support means as a function of signature thickness.

24. The device of claim 18 wherein:

the rotating means includes means for controlling the speed of the signature support means as a function of signature separation on the infeed conveyor.

25. The device of claim 18 wherein:

the rotating means includes means for controlling the speed of the signature support means as a function of signature thickness and signature separation on the infeed conveyor.

26. The method of claim 1 including driving the signature support at a succession of decreasing velocities to slow the signature support to a stop at the intercept ready position.

27. The device of claim 7 wherein the control means controls the servomotor means to rotatably drive the signature support at a succession of decreasing velocities to slow the signature support to a stop at the intercept ready position.

* * * * *